US006035600A

United States Patent [19]

Habicht et al.

[11] Patent Number: 6,035,600

[45] Date of Patent: Mar. 14, 2000

[54] HEAT-INSULATED COMPOSITE SECTION FOR DOORS, WINDOWS OR FACADES

[75] Inventors: Siegfried Habicht, Leopoldshöhe; Andreas Freier, Löhne; Eitel-Friedrich Höcker, Bielefeld, all of Germany

[73] Assignee: Schüco International KG, Bielefeld, Germany

[21] Appl. No.: 08/922,199

[22] Filed: Sep. 2, 1997

[30] Foreign Application Priority Data

Sep. 17, 1996 [DE] Germany ..... 196 37 858

[51] Int. Cl.[7] ..... E04B 1/94

[52] U.S. Cl. ..... 52/717.02; 52/573.1; 52/656.5; 52/656.7; 52/730.3; 52/730.5; 52/730.6

[58] Field of Search ..... 52/656.2, 656.3, 52/656.5, 656.6, 656.7, 717.02, 573.1, 730.3, 730.4, 730.5, 730.6; 403/28, 29, 30

[56] References Cited

U.S. PATENT DOCUMENTS

| | | | |
|---|---|---|---|
| 3,878,660 | 4/1975 | Jacob | 52/730.5 X |
| 4,115,972 | 9/1978 | Varlonga | 52/730.6 X |
| 4,158,512 | 6/1979 | Hasselbacher | 52/717.02 X |
| 4,219,983 | 9/1980 | Kern et al. | 52/730.3 |
| 4,231,207 | 11/1980 | Kern et al. | 52/730.3 |
| 5,117,601 | 6/1992 | Habicht | 52/717.02 X |
| 5,727,356 | 3/1998 | Ensinger et al. | 52/717.02 |

*Primary Examiner*—Carl D. Friedman
*Assistant Examiner*—Timothy B. Kang
*Attorney, Agent, or Firm*—Henry M. Feiereisen

[57] ABSTRACT

A heat-insulated composite section for doors, windows and facades, includes a plurality of metal rail sections so connected as to form a frame, at least one insulating rod arranged between the rail sections and having longitudinal edges secured to the metal sections, and a compensation structure provided in a longitudinal connection zone between interconnected components for eliminating a flexure of the rail sections when subject to uneven temperature rise. The compensation structure effects a slight resistance to longitudinal displacement, or resistance to longitudinal displacement that approaches zero, or is formed by a sliding-type guidance.

16 Claims, 8 Drawing Sheets

HEAT-INSULATED COMPOSITE SECTION FOR DOORS, WINDOWS OR FACADES

BACKGROUND OF THE INVENTION

The present invention generally refers to a composite section for doors, windows or facades, and in particular to a heat-insulated composite section of a type including metal rail sections and at least one insulating rod, preferably made of plastic material, positioned between the rail sections and connected to the rail sections along the longitudinal edges.

It is known to secure the insulating rods along the longitudinal edges through force-fitting engagement in undercut grooves of the rail sections by forming a metal web. By this type of engagement alone, the friction pairing between the insulating rod and the rail sections results in a resistance to longitudinal displacement between the rail sections which could be augmented through further measures such as a coating that increases friction, serrated groove surfaces or provision of at least one toothed wire placed between the attached metal web and the insulating rod.

The resistance to longitudinal displacement of the composite section results in a higher, effective moment of inertia for static loads in conjunction with bar-post-constructions employed in metal structures.

Other composite profiled systems describe the securement of the insulating rod by means of mechanical spreaders or bloating foams.

The force-fitting connection or positive engagement in longitudinal direction between the insulating rods and the rail sections of the composite sections is capable of absorbing increased forces of displacement when subject to static or dynamic loads caused e.g. by wind-generated suction or pressure forces, and thus reducing flexures at static or dynamic loads in respect to the addition of individual moments of inertia of single rail sections assembled to form a composite section. This type of composite section is called "displacement-resistant" composite.

The insulating rods form between the metal rail sections a thermal partition plane by which the heat flux from one rail section to the other rail sections is limited to a minimum.

In the event the rail sections of the displacement-resistant composite section are unilaterally subjected to a temperature rise, the length expansion of the heated rail section results in a displacement force between the rail sections of the composite section to thereby cause a flexure of the composite section because of the resistance to longitudinal displacement of the composite section. Heat sources that may effect a one-sided temperature rise are e.g. temperature differences between a room inner side and the outer air (winter operation) or incident solar radiation upon the outside (summer operation) that leads to a temperature rise of the outside through absorption of solar energy. The ensuing deformation of the composite section causes always an arching toward the warmer side and impairs the function of the window or door as the frame thereof is made from a composite section.

Especially when the rail sections are relatively long, e.g. vertical frame sections of doors, flexures caused as a consequence of the one-sided heating adversely affect the tightness and the locking capability of the locks. This is true for a simple center lock or a multiple lock so that a breakdown of the locking function may be experienced.

Temperature fluctuations from 50 to 60° C. as a result of incident solar radiation upon dark surfaces, may cause flexures of such an extent that even the compensation capability of sealing systems may not be sufficient to close the created gap. The flexure created by temperature differences between the outer and the inner metal rail sections of the composite section also leads to stress upon the provided lock of a door. This stress is experienced in conventional multiple-lock mechanisms at least in connection with one of the locks so that the door cannot be securely closed or opened by the key.

SUMMARY OF THE INVENTION

It is thus an object of the present invention to provide an improved heat-insulated composite section, obviating the afore-stated drawbacks.

In particular, it is an object of the present invention to provide an improved heat-insulated composite section by which length variations of one metal rail section during changing temperature loads are not transmitted to the other metal rail section as a result of displacement forces.

These objects, and others which will become apparent hereinafter, are attained in accordance with the present invention by limiting in a longitudinal connection zone between the connected metal rail sections of the heat-insulated composite section the resistance to longitudinal displacement to a small value which may reach zero, or by forming a sliding-type guidance in the longitudinal connection zone.

In this manner, varying length changes of the rail sections of the heat-insulated composite section occur independently from one another as a result of different temperature loads.

The longitudinal connection zone with slight resistance to longitudinal displacement, or with resistance to longitudinal displacement that approaches zero, or with a sliding-type guidance can be formed by the connection zone between a longitudinal edge area of an insulating rod and the associated rail section. It is however also possible to form the insulating rod of two-part configuration and to provide the longitudinal connection zone between both these rod parts with a slight resistance to longitudinal displacement, or with a resistance to longitudinal displacement that approaches zero, or with a sliding-type guidance.

According to another feature of the present invention, the sliding-type guidance is effectuated by guide surfaces formed by one metal rail section in the connection zone and oriented substantially perpendicular to a center axis of the insulating rod, or so oriented as to deviate from the perpendicular disposition with regard to a center axis of the insulating rod by up to ±20° . The sliding-type guidance may also be effected by a groove formed in one rail section and a guide arm formed on the insulating rod and received with play in the groove. Suitably, the groove is an undercut groove bound by border webs of the rail section facing the insulating rod, with the border webs demarcating a longitudinal slot of the metal rail section, whereby the guide arm has a neck extending through the slot and formed integrally with a cylindrical guide member which engages behind the border webs.

The groove may also exhibit a trapezoid cross section, with the guide arm having a trapezoid cross section.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
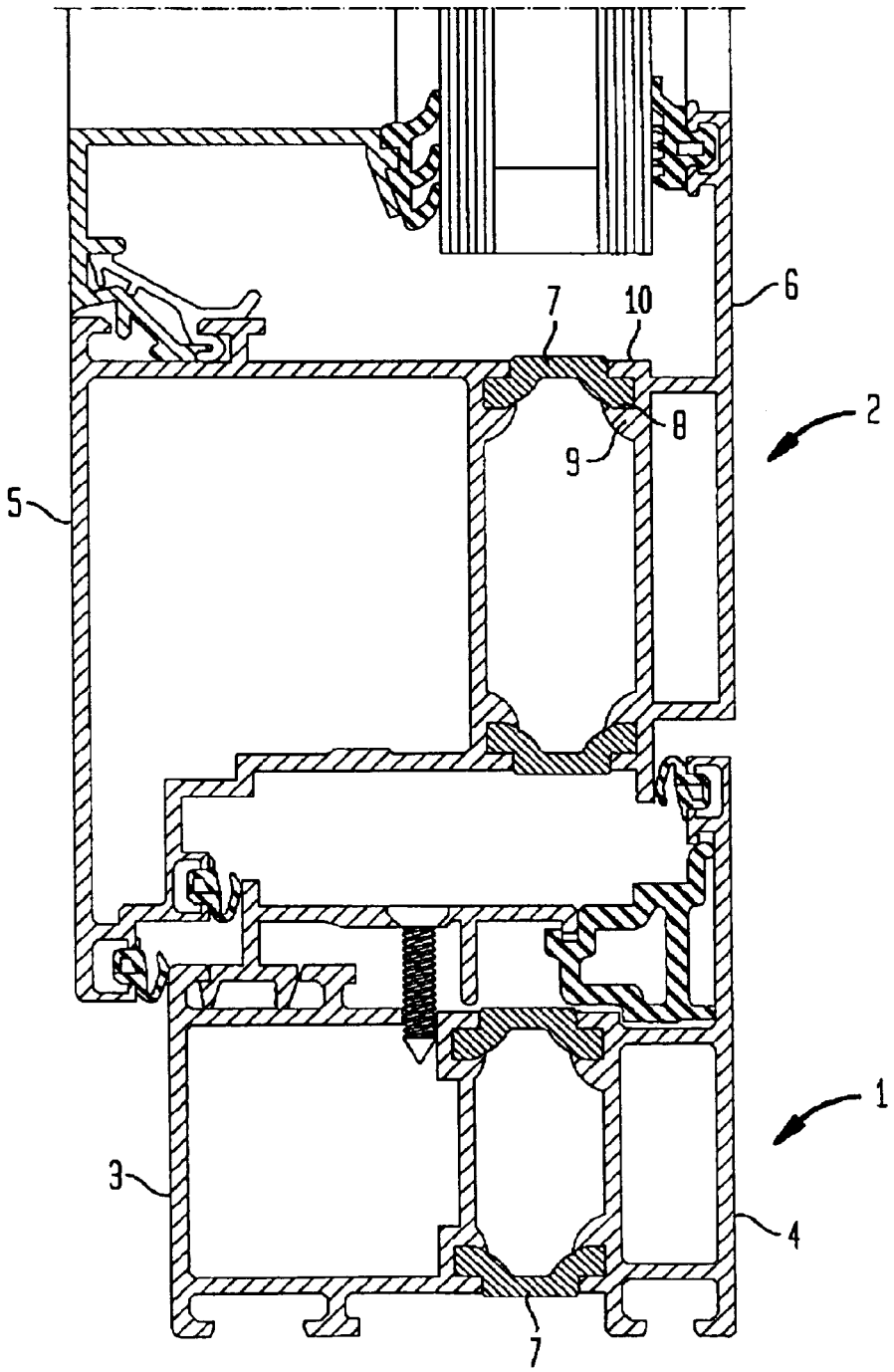
FIG. 1 (PRIOR ART)
FIG. 1. is a horizontal section through a window with casement and window frame being constructed out of a conventional heat-insulated composite section.

Throughout all the Figures, the same or corresponding elements are generally indicated by the same reference numerals.

Turning now to the drawing, and in particular to FIG. 1, there is shown a horizontal section through a window with a window frame, generally designated by reference numeral 1 and constructed out of a conventional heat-insulated composite section in the form of a metal rail section 4 on the outside and a metal rail section 3 facing inwardly, and with a casement, generally designated by reference numeral 2 and constructed out of a conventional heat-insulated composite section in the form of a metal rail section 6 on the outside and a metal rail section 5 facing inwardly. Insulating rods 7 made of plastic material connect the rail sections 3, 4 to the rail sections 5, 6. The insulating rods 7 engage with their longitudinal edge area 8 in grooves of the rail sections 3, 4; 5, 6, with the grooves being formed by metal webs 9, 10. After insertion of the edge areas 8 into the grooves of the rail sections, the webs 10 are so formed onto the insulating rods 7 as to effect between the insulating rods 7 and the rail sections 3, 4, 5, 6 a composite which ensures a resistance to longitudinal displacement of the composite section and in addition a resistance to transverse tension. Optionally, further measures such as a coating that increases the friction, serrated groove surfaces or provision of at least one toothed wire placed between the attached metal web and the insulating rod may be provided to augment the resistance to longitudinal resistance.

Conventional composite sections of this type have however the drawback of varying deformations of the displacement-resistant interconnected rail sections 3, 4; 5, 6 at different heat exposures. This drawback is now eliminated in accordance with the present invention, as will now be described in more detail with reference to FIGS. 2 to 8.

Figure 2:
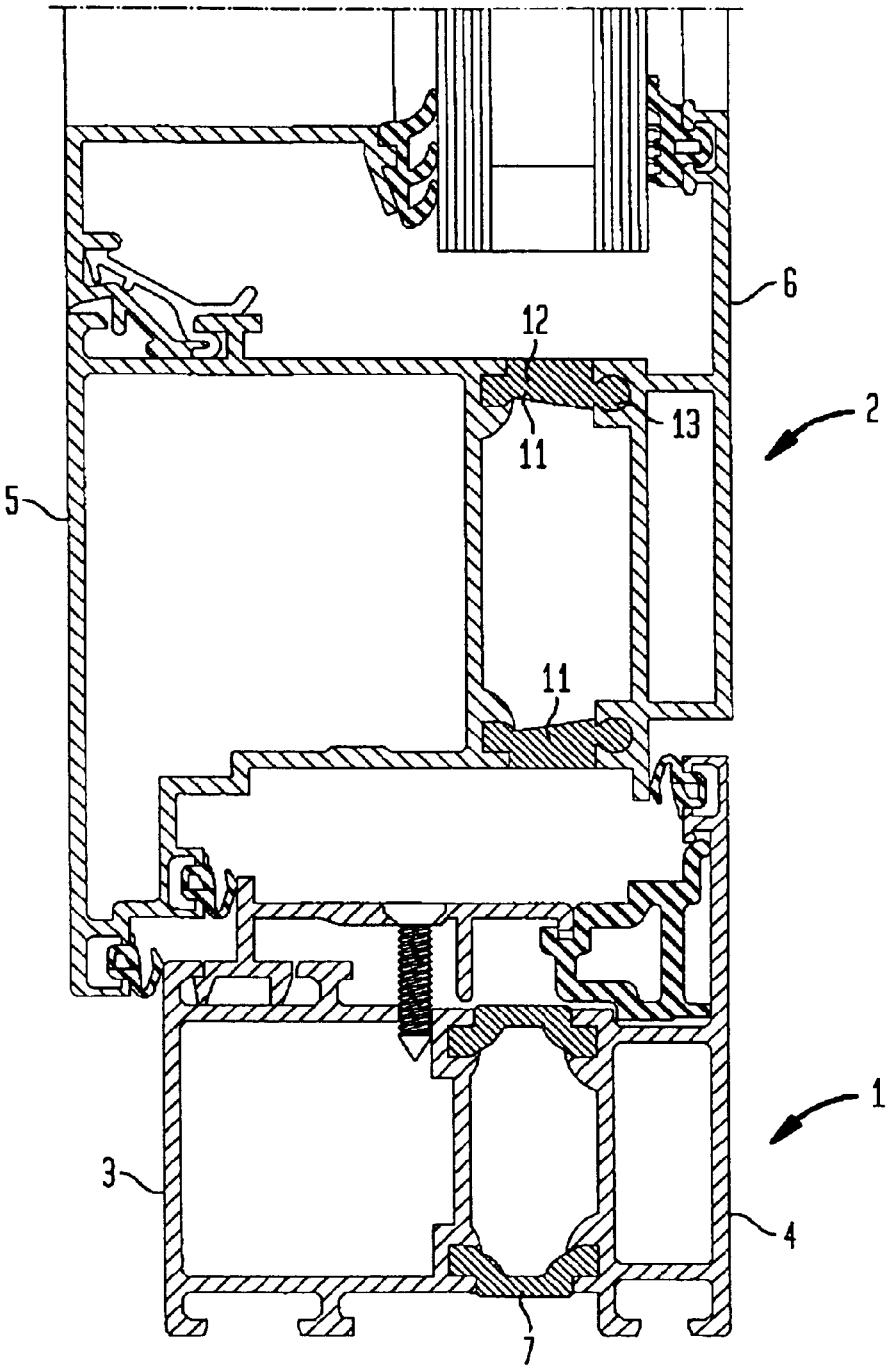
FIG. 2 is a horizontal section through a window with casement and window frame being constructed out of a heat-insulated composite section in accordance with a first embodiment of the present invention.

FIG. 2 shows a horizontal section through a window, with the window frame 1 being constructed out of a heat-insulated composite section in a same manner as described in connection with FIG. 1, while the casement 2 is constructed out of a heat-insulated composite section in accordance with a first embodiment of the present invention. As shown in FIG. 2, the inner and outer metal rail sections 5, 6 are interconnected to one another by insulating rods 11 which are so designed as to engage non-displaceably with its longitudinal edge area 12 in the metal rail section 5 while the opposite longitudinal edge area is shaped in the form of a guide arm 13 which is slidably supported in an undercut groove of the outer rail section 6.

Figure 4:
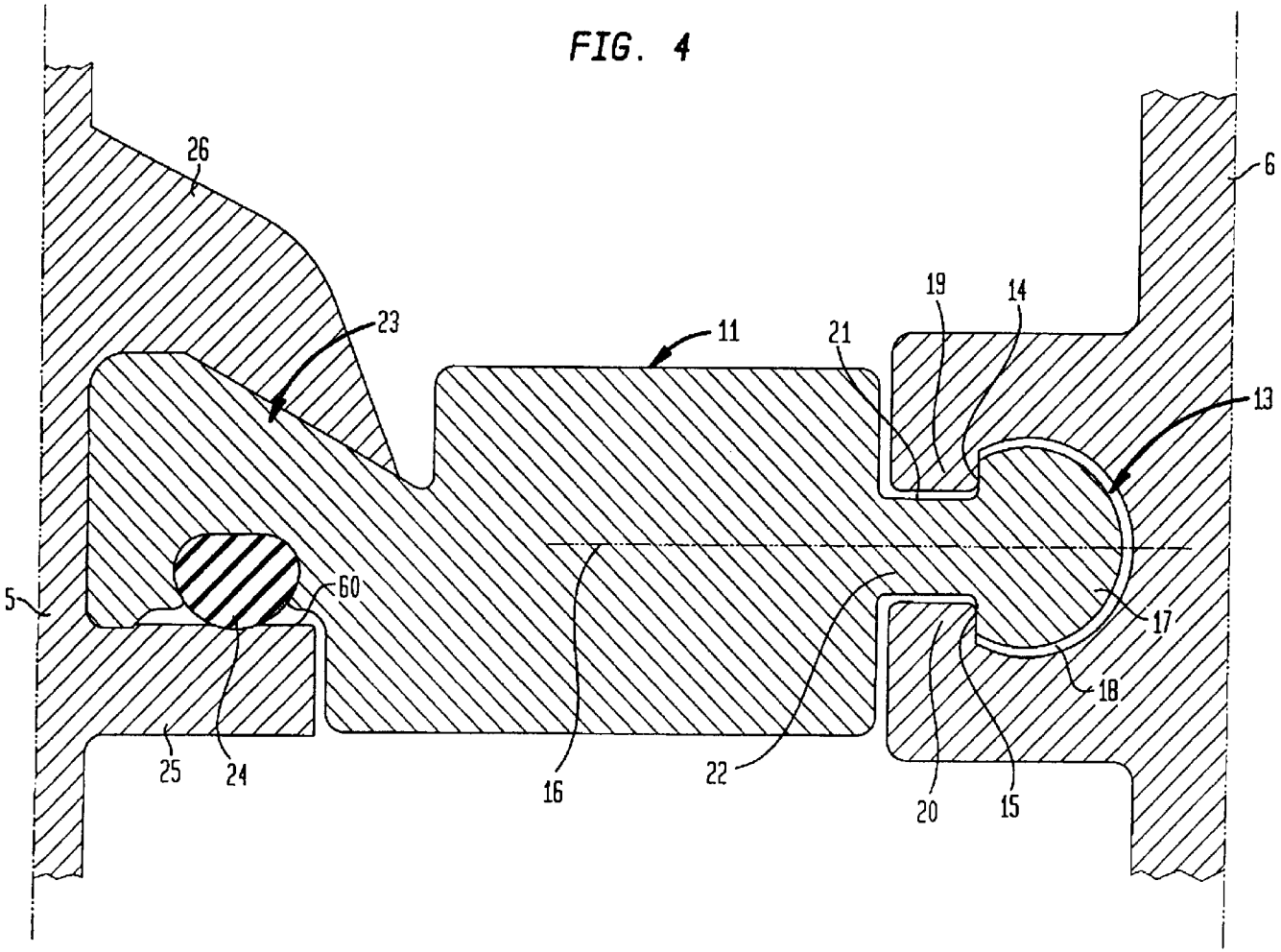
FIG. 4 is a sectional cutaway view, on an enlarged scale, of an insulating rod positioned between two metal rail sections.

FIG. 4 is a sectional cutaway view, on an enlarged scale, of the insulating rod 11 positioned between two rail sections 5, 6, and it can be seen that the guide arm 13 of the insulating rod 11 has the shape of a cylindrical guide member 17 which is received in a groove 18 of the outside rail section 6 and so configured as to form with the metal section 6 sliding surfaces 14, 15 which extend perpendicular or substantially perpendicular to a center axis 16 of the insulating rod 11. The deviation of the perpendicular disposition of the sliding surfaces 14, 15 relative to the center axis 16 may range up to ±20°.

The provision of sliding surfaces 14, 15 results in a definite, dimensional association of the insulating rod 11 relative to the rail section 6 so that the clearance required for the sliding-type guidance between the guide member 17 of the guide arm 13 and the undercut groove 18 is ensured.

As further shown in FIG. 4, the rail section 6 is so shaped as to form inwardly facing webs 19, 20 which bound a longitudinal slot 21 through which a neck 22 of the insulating rod 11 extends, with the neck 22 being formed in one piece with the guide member 17. The guide arm 13 may have any suitable cross sectional geometric shape, provided the clearance required for the sliding-type guidance is ensured between the guide arm 13 and the wall of the undercut groove 18 of the rail section 6.

At the end opposite to the guide arm 13, the insulating rod 11 is formed with a border strip 23 which is securely received in an anchoring groove 60 bound by opposite anchoring webs 25, 26 of the rail section 5 so as to be resistant to a longitudinal displacement. To augment the securement of the border strip 23 in the anchoring groove 60 and to increase the resistance to longitudinal displacement, a wire 24 is placed in the anchoring groove 60 of the rail section 5 and partially embedded in the border strip 23 of the insulating rod 11. The wire 24 may further be formed with a surface texture. The positive connection between the anchoring web 25 and the wire 24 and thus the border strip 23 results in conjunction with the anchoring web 26 in a displacement-resistant composite between the rail section 5 and the insulating rail 11.

Figure 3:
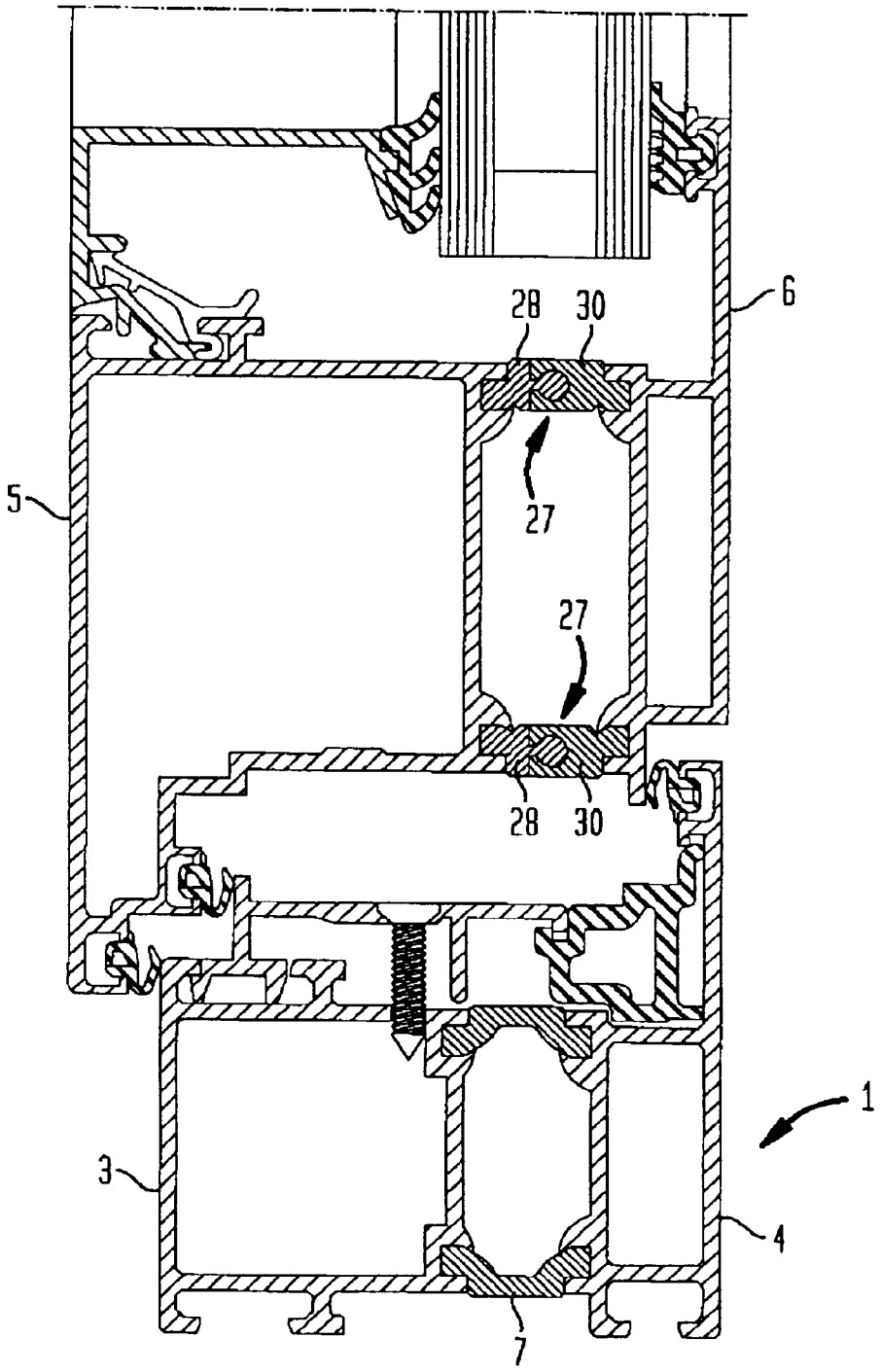
FIG. 3 is a horizontal section through a window with casement and window frame being constructed out of a heat-insulated composite section in accordance with of a second embodiment of the present invention.

In FIG. 3, there is shown for connection of the rail sections 5, 6, of the casement 2 an insulating rod 27 of two-part configuration, comprised of a rod part 28 which is anchored in the inside rail section 5 and is formed at the end distant to the rail section 5 with a guide arm 29, and a rod part 30 which is anchored in the outside rail section 6 and is formed at the end proximate to the rail section 5 with an undercut groove 31 for receiving the guide arm 29.

Figure 5:
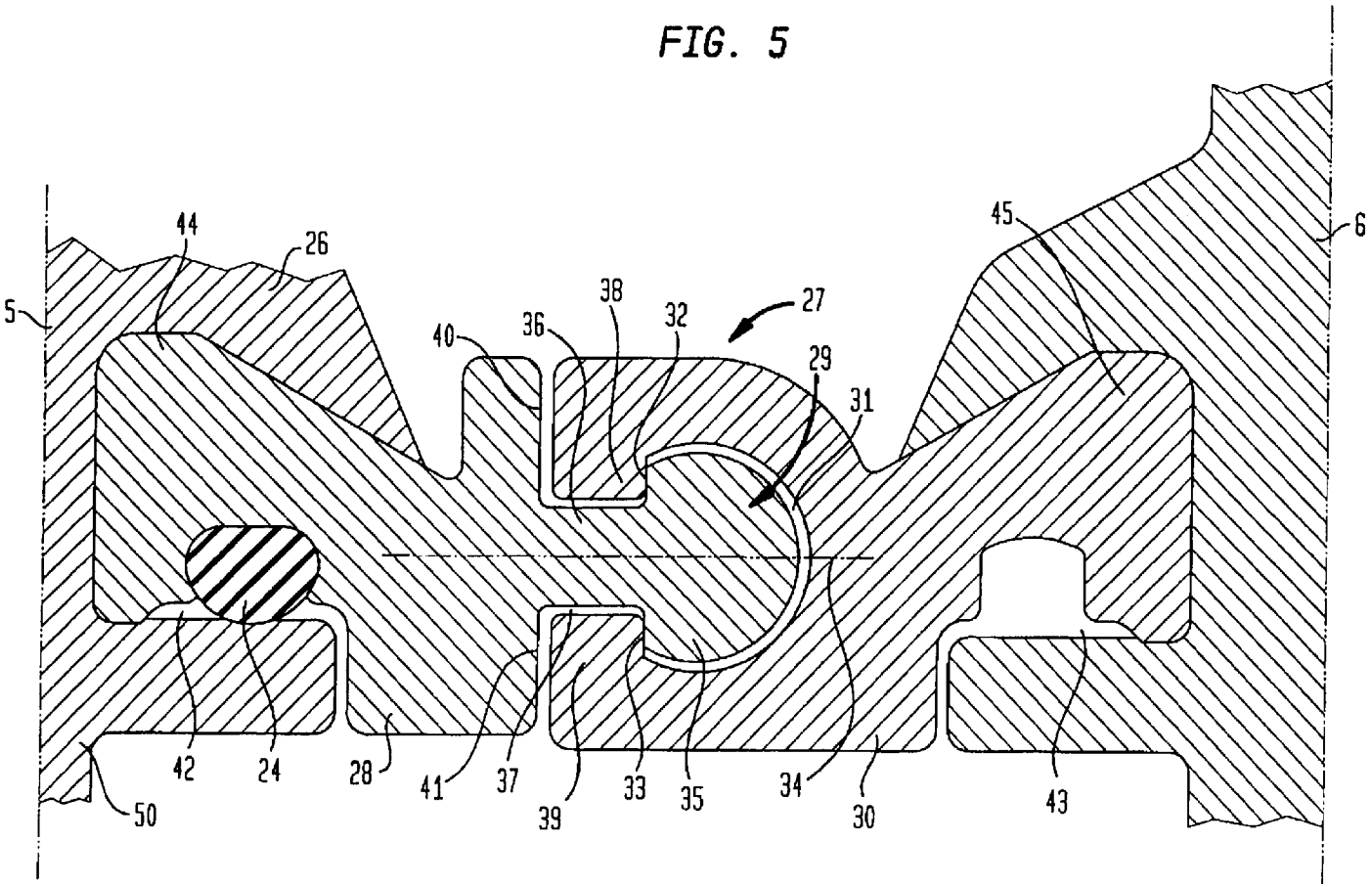
FIG. 5 is a sectional cutaway view, on an enlarged scale, of a variation of an insulating rod positioned between the rail sections.

Referring now to FIG. 5, there is shown a sectional cutaway view, on an enlarged scale, of the insulating rod 27 positioned between two rail sections 5, 6, and it can be seen that the sliding-type guidance between the rod parts 28 and 30 is formed by guide surfaces 32, 33 which extend perpendicular or substantially perpendicular to a longitudinal center axis 34. The guide arm 29 is formed with a cylindrical guide member 35 that is formed in one piece with a neck 36 extending through a longitudinal slot 37 of the undercut groove 31, with the slot 37 being formed by the inwardly directed opposite border strips 38, 39 of the rod part 30. The rod part 28 is formed with stop surfaces 40 positioned at a clearance to the border strips 38, 39, 41, and is received with its attachment foot 44 in an anchoring groove 42 of the rail section 5, while the rod part 30 is formed with an attachment foot 45 for placement in an anchoring groove 43 of the rail section 6. Both attachment feet 44, 45 are thus so connected to the rail sections 5, 6, respectively, as to be resistant to a longitudinal displacement, whereby the stationary connection between the attachment foot 44 and the rail section 5 is further augmented by the incorporation of the wire 24 in a manner described with respect to FIG. 4.

Figure 6:
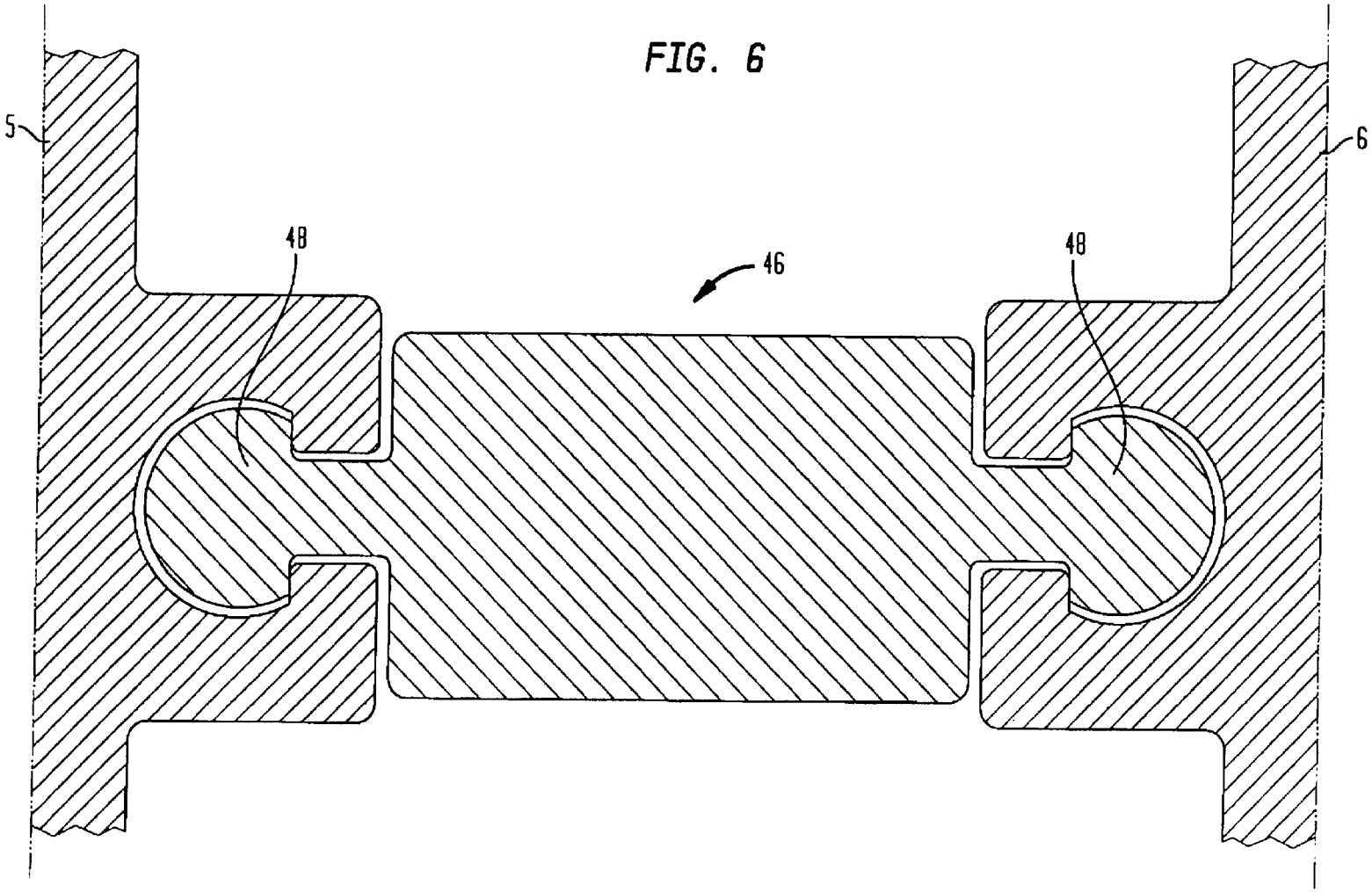
FIG. 6 is a sectional cutaway view, on an enlarged scale, of still another variation of an insulating rod positioned between the rail sections.

In FIG. 6, there is shown for connection of the rail sections 5, 6, of the casement 2 an insulating rod 46 which is secured along both longitudinal sides by a sliding-type guidance to the rail sections 5, 6. The insulating rod 46 is formed at the longitudinal sides with guide arms 48 which resemble the guide arm 13 of FIG. 4 and the guide arm 29 of FIG. 5 as far as three-dimensional shape and functionality are concerned.

Figure 7:
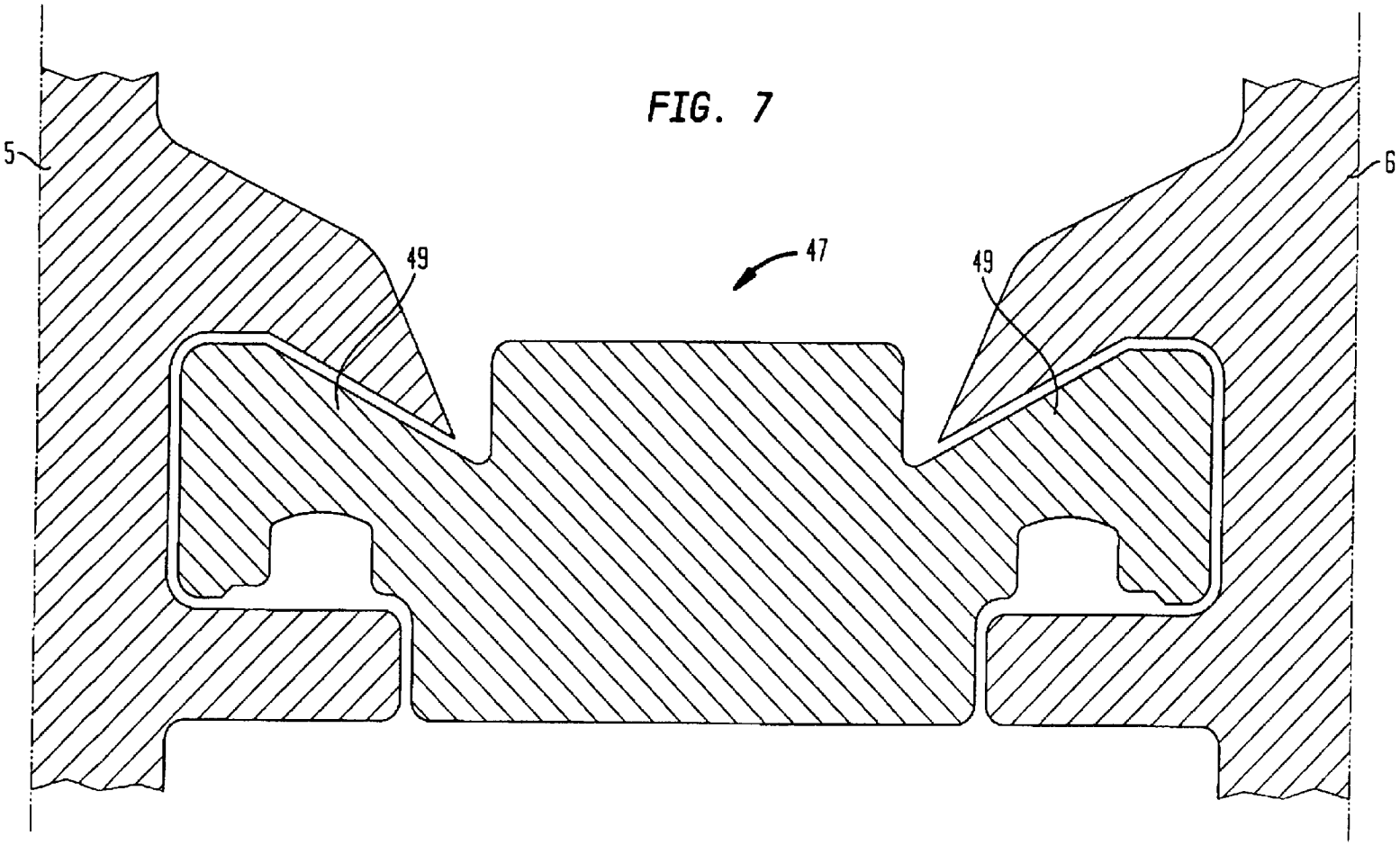
FIG. 7 is a sectional cutaway view, on an enlarged scale, of yet another variation of an insulating rod positioned between the rail sections.

In FIG. 7, there is shown a single-piece insulating rod 47 formed with guide arms 49 of trapezoidal configuration for securement in the rail sections 5, 6 via a sliding-type guidance to allow displacement in longitudinal direction. Persons skilled in the art will understand that other geometric cross sectional configurations of the guide arm are conceivable so long as a sufficient clearance for the sliding-type guidance is ensured between the guide arm and the associated undercut groove of the rail section.

Heat-insulated composite sections according to the present invention may also be used for frame sections or post sections in which in a longitudinal connection zone between interconnected components the resistant to longitudinal displacement is small, approaches zero or includes a sliding-type guidance.

Figure 8:
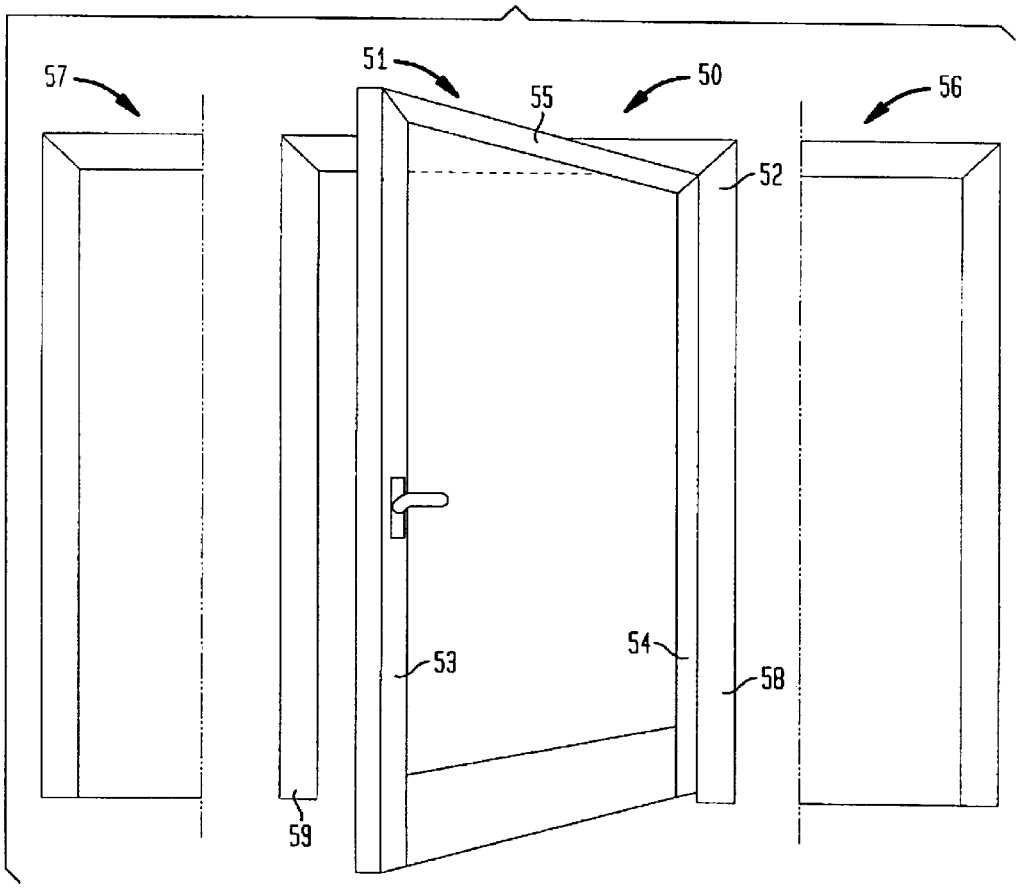
FIG. 8 is a perspective view of a door with door frame being constructed out of a heat-insulated composite section in accordance with the present invention.

Turning now to FIG. 8, there is shown a perspective view of a door, generally designated by reference numeral 50 comprised of a leaf 51 having parallel uprights 53, 54 and an interconnecting top rail 55, and a door frame 52 having parallel jambs 58, 59. When securing the door frame 52 in a masonry or other construction, generated bending forces are transmitted via fasteners into the masonry or other construction so that a flexure of the door frame 52 is not encountered. In this case, only the uprights 53, 54 of the leaf 51 are formed by a heat-insulated composite section according to the present invention. Through the corner connection of the uprights 53, 54 with the top rail 55, the composite section according to the present invention of the uprights 53, 54 is provided with a fixed point in the U-shaped frame. As a consequence of a temperature difference, the length extension of the metal rail sections of the uprights 53, 54 can thus be effected freely toward the underside of the U-shaped door frame. Thus, the top rail 55 can be designed as a conventional composite section that resists a longitudinal displacement.

In the event, the door frame 52 is formed with side elements 56, 57, as additionally indicated in FIG. 8, it may be suitable to form the jambs 58, 59 of a composite section according to the present invention whereby in the longitudinal connection zone between the interconnected components the resistant to longitudinal displacement is small, or approaches zero, or includes a sliding-type guidance.

While the invention has been illustrated and described as embodied in a heat-insulated composite section for doors, windows or facades, it is not intended to be limited to the details shown since various modifications and structural changes may be made without departing in any way from the spirit of the present invention.

What is claimed as new and desired to be protected by Letters Patent is set forth in the appended claims:

1. A heat-insulated composite section for doors, windows and facades, comprising:

a plurality of metal rail sections so connected as to form a frame;

at least one insulating rod arranged between the rail sections and having longitudinal edges secured to the rail sections; and compensation means provided in a longitudinal connection zone between interconnected components for eliminating a flexure of the rail sections when subject to uneven temperature rise, wherein the insulating rod is of two-part configuration having a first rod member connected with one rail section in a manner to resist a longitudinal displacement, and a second rod member connected with another rail section in a manner to resist a longitudinal displacement, with the first and second rod members being connected at a central location by the compensation means in the form of a sliding-type guidance.

2. The composite section of claim 1 wherein the insulating rod is made of plastic material.

3. The composite section of claim 1 wherein the compensation means effects a slight resistance to longitudinal displacement in the longitudinal connection zone.

4. The composite section of claim 1 wherein the compensation means effects a resistance to longitudinal displacement in the longitudinal connection zone that approaches zero.

5. The composite section of claim 1 wherein the sliding-type guidance is effected by guide surfaces formed by one rail section in the longitudinal connection zone and oriented substantially perpendicular to a center axis of the insulating rod.

6. The composite section of claim 1 wherein the sliding-type guidance is effected by guide surfaces formed by one rail section in the longitudinal connection zone and so oriented as to deviate from a perpendicular disposition with regard to a center axis of the insulating rod by ±20°.

7. The composite section of claim 1 wherein the sliding-type guidance is effected by a groove formed in one rail section and a guide arm formed on the insulating rod and received with play in the groove.

8. The composite section of claim 7 wherein the one rail section has opposing border webs facing the insulating rod to define the groove in the form of an undercut groove and to demarcate a longitudinal slot of the rail section, said guide arm having a neck extending through the slot and a cylindrical guide member formed integrally with the neck and engaging behind the border webs.

9. The composite section of claim 7 wherein the groove is undercut and exhibits a trapezoid cross section, with the guide arm having a trapezoid cross section.

10. The composite section of claim 1 wherein one of the rod members has an undercut groove and the other one of the rod members has a guide arm received with play in the groove.

11. The composite section of claim 10 wherein one rod member has opposing border webs to demarcate the undercut groove and to form a lateral longitudinal slot, said guide arm having a neck extending through the slot and formed in one piece with a cylindrical guide member.

12. The composite section of claim 11 wherein the other rod member is formed with stop surfaces extending parallel to the border webs.

13. The composite section of claim 1, wherein one of the rail sections is provided with an anchoring groove opposite the attachment foot of the corresponding rod member and a wire placed in said anchoring groove between the attachment foot and the groove, thereby increasing resistance against longitudinal displacement.

14. A heat-insulated composite section for doors, windows and facades, comprising:

a plurality of metal rail sections so connected as to form a frame;

at least one insulating rod arranged between the rail sections and having longitudinal edges; and compensation means provided in a longitudinal connection zone between interconnected components for eliminating a flexure of the rail sections when subject to uneven temperature rise, wherein the compensation means is formed by a sliding-type guidance which is effected by a groove formed in one rail section and a guide arm formed on the insulating rod and received with play in the groove and wherein the one rail section has opposing border webs facing the insulating rod to define the groove in the form of an undercut groove and to demarcate a longitudinal slot of the rail section, said guide arm having a neck extending through the slot and a cylindrical guide member formed integrally with the neck and engaging behind the border webs.

15. A heat-insulated composite section for doors, windows and facades, comprising:

a plurality of metal rail sections so connected as to form a frame;

at least one insulating rod arranged between the rail sections and having longitudinal edges; and compensation means provided in a longitudinal connection zone between interconnected components for eliminating a flexure of the rail sections when subject to uneven temperature rise; wherein the compensation means is formed by a sliding-type guidance which is effected by an undercut groove formed in one rail section and a guide arm formed on the insulating rod and received with play in the groove, with the guide arm having a trapezoid cross section.

16. A heat-insulated composite section for doors, windows and facades, comprising:

a plurality of metal rail sections at least one insulating rod arranged between the rail sections and having longitudinal edges; and compensation means provided in a longitudinal connection zone between interconnected components for eliminating a flexure of the rail sections when subject to uneven temperature rise; wherein the insulating rod is of two-part configuration having a first rod member connected with one rail section in a manner to resist a longitudinal displacement, and a second rod member connected with another rail section in a manner to resist a longitudinal displacement, with the first and second rod members being connected at a central location by the compensation means in the form of a sliding-type guidance; wherein the one of the rod members has an undercut groove and the other one of the rod members has a guide arm received with play in the groove wherein the one rod member has opposing border webs to demarcate the undercut groove and to form a lateral longitudinal slot, said guide arm having a neck extending through the slot and formed in one piece with a cylindrical guide member.

* * * * *